US005903987A

United States Patent [19]

Nüske

[11] Patent Number: 5,903,987

[45] Date of Patent: May 18, 1999

[54] SIDE PLOW ASSEMBLY

[76] Inventor: Reinhold HKW Nüske, Björnö 1530, Haninge, Sweden, 136 91

[21] Appl. No.: 08/838,123

[22] Filed: Apr. 15, 1997

[51] Int. Cl.[6] ..... E01H 5/06

[52] U.S. Cl. ..... 37/281; 37/234; 37/236

[58] Field of Search ..... 37/281, 279, 266, 37/236, 234, 231, 274, 235

[56] References Cited

U.S. PATENT DOCUMENTS

| | | | |
|---|---|---|---|
| 1,880,984 | 10/1932 | Remington | 37/281 |
| 2,011,777 | 8/1935 | Ritchie | 37/231 |
| 2,199,593 | 5/1940 | Kaeser | 37/235 |
| 2,241,252 | 5/1941 | Garland et al. | 37/236 |
| 2,991,566 | 7/1961 | Sumner et al. | 37/232 |
| 3,659,363 | 5/1972 | Snyder | 37/231 |
| 3,720,010 | 3/1973 | Coates | 37/281 |
| 3,908,289 | 9/1975 | Ross | 37/231 |
| 4,096,652 | 6/1978 | Raines et al. | 37/231 |
| 4,357,766 | 11/1982 | Croteau | 37/281 |
| 4,470,211 | 9/1984 | Rossmann | 37/231 |
| 4,744,159 | 5/1988 | Houle | 37/231 |
| 4,754,562 | 7/1988 | McGarrah et al. | 37/232 |
| 4,969,280 | 11/1990 | Thorneloe | 37/281 |
| 5,031,343 | 7/1991 | Houle et al. | 37/231 |
| 5,048,207 | 9/1991 | Verseef | 37/281 |
| 5,050,322 | 9/1991 | Burkard | 37/270 |

*Primary Examiner*—Victor Batson

*Attorney, Agent, or Firm*—Jacobson, Price, Holman & Stern, PLLC

[57] ABSTRACT

A side plow assembly for an automotive vehicle, particularly a lightweight vehicle such as a lightweight truck, pick-up or like vehicle, and then particularly a four-wheel drive vehicle. The assembly includes a plow share mounted on one side of the vehicle. Seen in the normal direction of travel of the vehicle, the front end of the plow share is pivotally connected to the vehicle chassis by a joint. The rear part of the share, as seen in the travel direction, is connected to a rear chassis part by an elongated brace whose length can be varied for adjustment of the angle of the side share in the horizontal plane relative to the travel direction. The brace is also pivotally connected to the chassis. The assembly also includes a lifting device which is connected between the plow share and the vehicle and functions to lift the share away from a ground surface and to lower the share into contact with the ground surface respectively.

7 Claims, 2 Drawing Sheets

SIDE PLOW ASSEMBLY

The present invention relates to a side plow assembly, and then particularly but not exclusively to a side plow assembly for a lightweight four-wheel-drive motor vehicle, such as a lightweight truck, pick-up or the like.

It is known to mount a snow plow on the front of a four-wheel drive pickup and use the plow to clear away snow in local areas. The front plow is normally suspended on the vehicle through the medium of a mechanism that, with the aid of hydraulic piston-cylinder devices, enables the angle defined between the longitudinal direction of the plow share, or plow wing, and the longitudinal direction of the vehicle to be changed and also enables the plow share to be lifted and lowered. The snow clearing capacity of such a vehicle equipped with a front plow share would be greatly enhanced if it were possible to provide the plow, in an economically acceptable manner, with a manoeuvrable side-plow share that could be swung in against the side of the vehicle and swung out to a desired working angle in relation to the longitudinal direction of the vehicle, and that could also be lifted out of contact and lowered into contact with the ground surface to be cleared.

The object of the invention is to provide a side plow assembly of simple construction and therewith enable the use of simple drive equipment that can be easily manoeuvred.

Another object of the invention is to provide a side plow assembly that can be easily fitted to and dismantled from said vehicle.

These objects are achieved with an inventive assembly defined in the following independent apparatus claims. The accompanying dependent claims define respective further embodiments of the assembly.

In one practical and preferred embodiment of the invention, there is used a four-wheel drive pick-up which has on its underside a longitudinally extending, exposed side frame-member adjacent that side of the vehicle on which the side plow share shall be fitted. This side member can be fitted with an attachment means that connects with the front end-part of the share. The attachment means is constructed to enable the plow share to be pivotally mounted. The attachment means also includes devices that permit limited vertical movement of the front share-part between two end positions. The front share-part is lifted out of engagement with the road surface in the first end position. The front share-part is able to move down to a level that is, e.g., at most 50 mm beneath the plane of the surface on which the vehicle wheels stand.

The rear part of the plow-share is coupled to a rear part of the vehicle chassis by means of elongated bracing means, preferably to a tow hook centrally on the rear part of the vehicle. The bracing means has a variable length, to enable the angle between the alignment of the side plow share with the longitudinal direction of the vehicle to be adjusted. The bracing means may also include a spring for equalising shock loads. The bracing means may also function to stabilise and adjust the side share with respect to its inclination in the vertical plane.

A lifting device, which includes a flexible load transfer element between its ends (e.g. a chain, a wire or the like) engages the plow share in a position forwardly of its centre of gravity. If it is assumed that the plow share rests on the ground surface, its forward end will be lifted first when the lifting device is activated, and when the front end of the share occupies its upper end position, it is this end position that forms a pivot point for continued lifting of the share, wherewith the share swings upwards about this pivot point.

The length of the bracing means, which supports the rear end of the share on the tow hook for instance, can be adjusted with the aid of a power cylinder, preferably a hydraulic cylinder, and can swing about the tow hook or its correspondence. According to one particularly preferred embodiment of the invention, the lifting device and the bracing means may each include a double-acting power cylinder that are connected in series in a circuit such that the side share will first be lifted from an originally oblique and outwardly swung position and then swung inwardly towards or against the side of the vehicle, and vice versa when reversing the direction of flow in the circuit. This arrangement minimizes the amount of hydraulic fluid required in the circuit.

In view of the fact that the vehicle will normally be equipped initially with a hydraulic unit that is coupled and controlled for manoeuvring the front plow share (the front plow assembly constitutes a prerequisite for effective use of the side plow assembly), it is thus possible to switch the hydraulic unit from its standard circuit to the hydraulic circuit that supplies power to both cylinders coacting with the side plow share, this control being simple to achieve and is effected by switching the flow direction of the working fluid and establishing and shutting down the hydraulic flow (and possibly also adjusting the magnitude of the flow). It will therefore be evident that the control devices for controlling the side plow assembly are simple in both design and manoeuvring, and that a selector valve can be easily fitted to enable adjustment to the hydraulic flow of the hydraulic unit from the front plow drive circuit to the side plow drive circuit.

An inventive plow assembly will now be described with reference to an exemplifying embodiment thereof and also with reference to the accompanying drawings.

Figure 1:
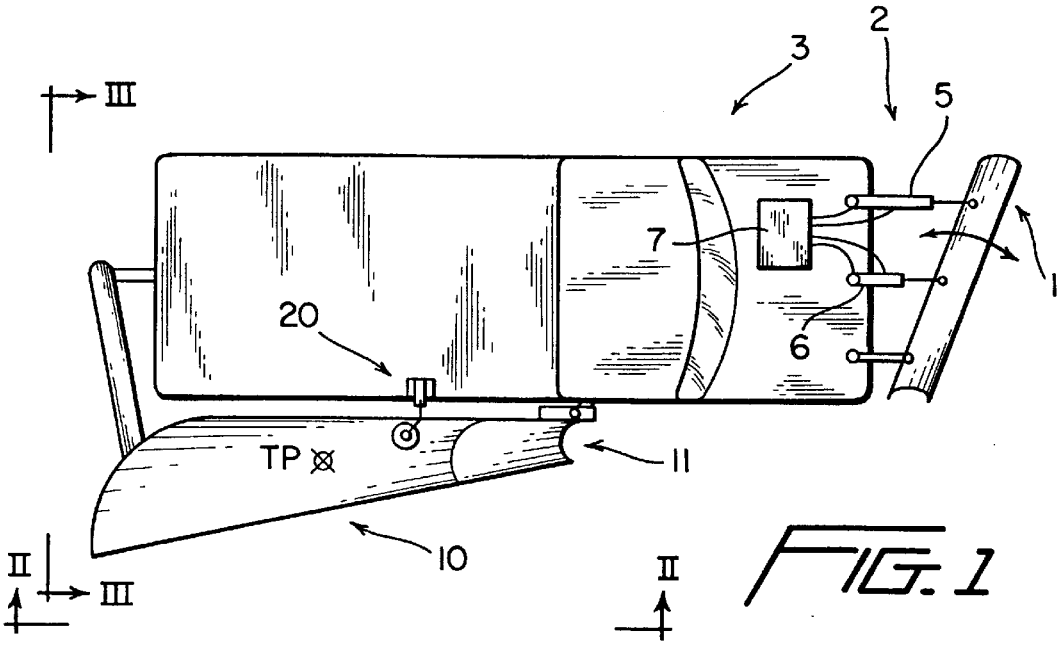
FIG. 1 is a schematic view from above of a four-wheel drive pick-up having a front-mounted side plow and an inventive side-mounted plow assembly.
Figure 2:
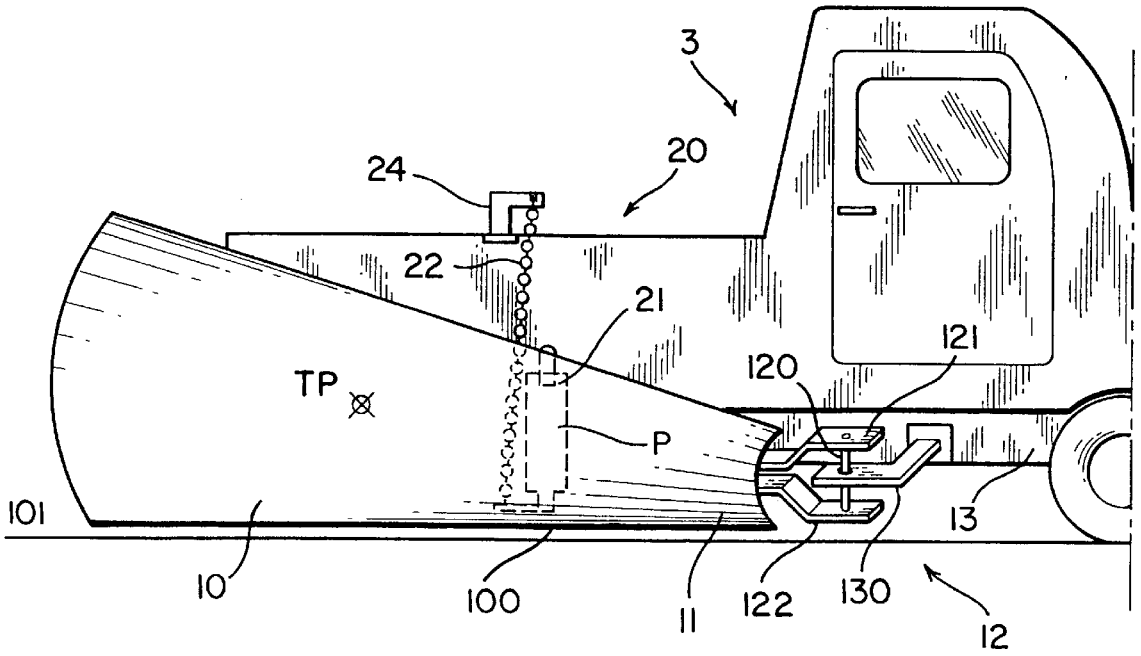
FIG. 2 is a schematic side view taken on the line II—II in FIG. 1.

FIG. 1 shows a four-wheel drive pick-up fitted with a front plow assembly 1 that is suspended mechanically at 2 on the front of the vehicle 3. The assembly includes an hydraulic cylinder 5 which functions to swing the plow share 1 in the horizontal plane, and a further hydraulic cylinder 6 which enables the share 1 to be raised and lowered. The vehicle 3 carries an hydraulic unit 7 having an hydraulic circuit in which the cylinders 5, 6 are connected, together with conventional control means for establishing desired movements of the share 1.

FIG. 1 shows a side-plow share 10 mounted on the right side of the vehicle 3. The front part 11 of the share 10 is located adjacent the side of the vehicle and is connected by a pivot means 12 to a nearby, exposed side member 13 on the underside of the vehicle 3. The joint means 12 is intended to form a pivot means for the plow share 10. The joint means may also be constructed to allow the front plow part 11 to freely move vertically between two end positions. In this regard, the joint means includes a vertical axle 120 which is driven by the front part of the share, and a respective upper end-stop and lower end-stop 121 and 122. The axle 120 extends through an opening in a fitting 130 fixedly mounted on the side member 13.

A lifting device 20 is mounted between the side plow and the pick-up, for instance on that side of the loading platform/ platform side-board located nearest the side plow. The lifting device 20 includes a vertically operating, double-acting hydraulic cylinder 21 which engages the plow share 10 at a position P that lies slightly forwards of the centre of gravity TP of the plow share. The cylinder housing 21 is mounted on the share and its downwardly extending piston rod is connected to a chain 22 which is connected in turn to an attachment means 24 carried by the vehicle and preferably removable therefrom. As the lifting device 20 lifts the share 20, the forward part of the share is lifted away from the ground surface 101 such as to bring the end-piece 130 into engagement with the stop means 121, whereafter the share 10 is swung-up around the joint means 12 so as to also lift the rear part of the share 10 away from the ground surface. The rear, lower part of the share 10 carries a slide shoe 48 that can slide on the ground surface such as to maintain the adjacent scraper edge-part of the share at a desired level relative to the ground surface. A corresponding slide shoe may also be mounted on the front part of the share.

Figure 3:
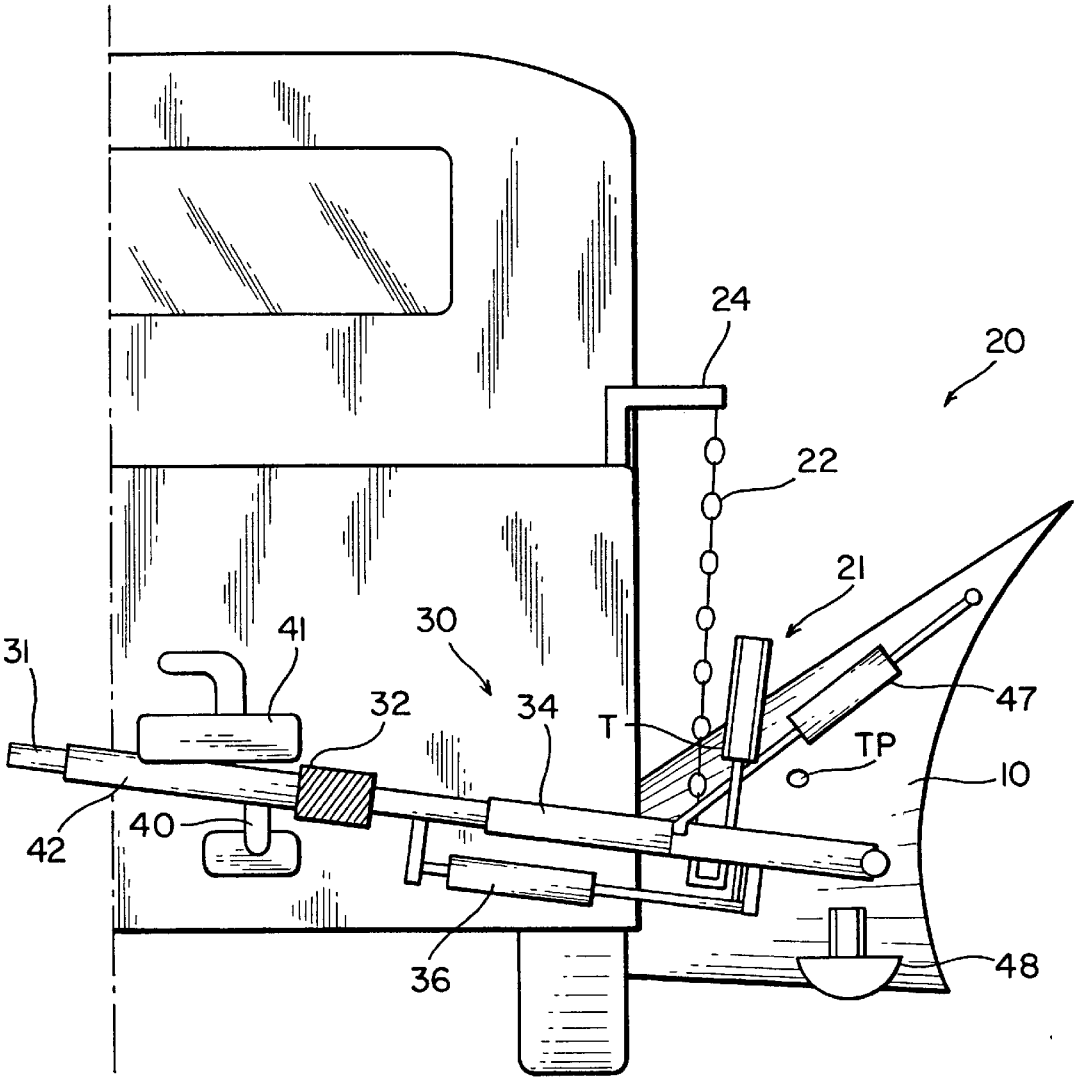
FIG. 3 is a schematic rear view of the subject of FIG. 1, said view being taken on the line III—III in FIG. 1.

As will be evident from FIGS. 1 and 3, the rear part of the share 10 is connected to elongated bracing means 30 attached to the vehicle tow hook 40 by means of a pivotal connection 41. The pivotal connection 41 may comprise a conventional trailer coupling and is connected to a sleeve 42 that receives one end of a rod 31 connected to the end of the sleeve 42 distal from the share 10 by means of a spring 32. The rod 31 is guided axially in relation to a further sleeve 34 whose outer end is connected to the share 10. The rod 31 and said further sleeve 34 include attachment plates between which a hydraulic cylinder 36 is connected for action in the longitudinal direction of the bracing means 30. An adjustable brace 47 is coupled between the rear upper part of the share 10 and the sleeve 34, for selective adjustment of the angle of the share 10. The share 10 can be swung-out to a working position and swung-in to a position adjacent the side of the vehicle 3, by driving the hydraulic cylinder 36 between its respective end positions.

Figure 4:
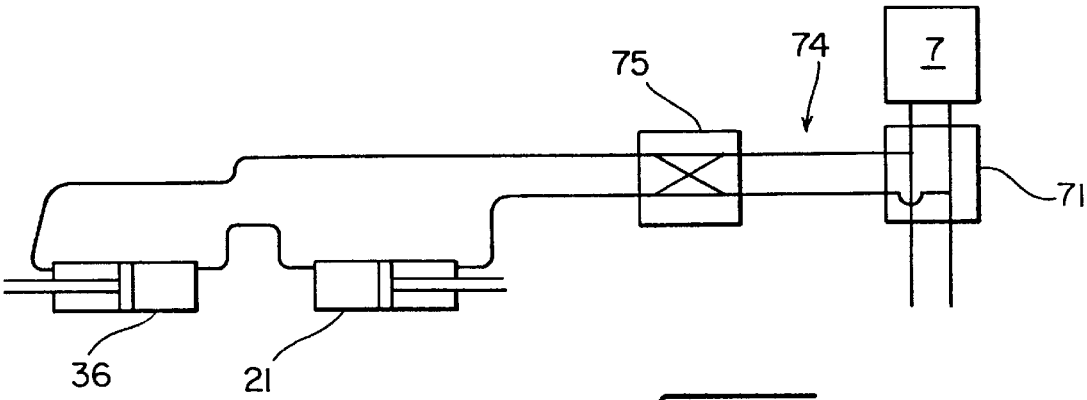
FIG. 4 is a diagrammatic illustration of the hydraulic circuit of the side plow assembly.

As will be evident from FIG. 4, the hydraulic unit 7 can be disconnected from the standard hydraulic circuit for the front plow 1 by means of a switch 71, and connected instead to a hydraulic circuit 74 that includes control means 75 for reversing the direction of hydraulic fluid through the circuit 74 and possibly for controlling the magnitude of said flow. The circuit 74 includes the double-acting cylinder 21 connected in series with the double-acting cylinder 36, so that the volume of working fluid expelled from one cylinder will be delivered to the second cylinder as an activating fluid volume, and vice versa. This enables the amount of fluid required by the circuit 74 to be minimized, so as to enable the hydraulic circuit of the side share unit to be readily coupled to the hydraulic unit of the front share.

With the share 10 folded out and in contact with the ground surface, hydraulic fluid is driven through the circuit 74 in one direction, such that the lifting cylinder 21 will begin to lift the share 10 in the aforedescribed manner, wherewith the piston in the cylinder 36 is retracted and folds the share in against the side of the vehicle 3, wherein the device 30 is able to swing around the tow-bar joint. When the two cylinders 21, 36 have reached their respective end positions, the share 10 will be lifted up and lain against the side of the vehicle. The share 10 is brought to an active position, by causing the hydraulic fluid to flow in the other direction in the circuit 74, wherewith the rear part of the fully uplifted share 10 begins to swing-out at the same time as the cylinder 21 begins to lower the rear part of the share 10. As the rear part of the share 10 comes into contact with the ground surface, the front part of the share 10 is swung down to the rear support point of the share 10 until the lifting device is relieved of the weight of said share.

I claim:

1. A side plow assembly for mounting on an automotive vehicle and comprising a plow share fitted on a side of said vehicle, wherein a front end of the plow share as seen in a normal direction of travel of said vehicle is capable of being pivotally connected to the vehicle by joint means, wherein a rear part of the plow share, as seen in the normal direction of vehicle travel, is connected to a rear part of the vehicle by bracing means having a variable length for variation of an angle of the plow share in a horizontal plane relative to the direction of vehicle travel, wherein the bracing means is capable of being pivotally connected to the vehicle, and wherein the assembly includes lifting means capable of being connected between the plow share and the vehicle and functioning to lift the plow share from a ground surface and to lower said plow share into contact with said ground surface respectively, the bracing means including a double-acting hydraulic cylinder, the lifting means including a double-acting hydraulic cylinder, the two hydraulic cylinders being connected in series in a hydraulic circuit in a manner such that with the plow share lifted and folded-in against the side of the vehicle a flow of hydraulic fluid through the circuit in one direction will cause the rear part of the plow share to swing outwards and also downwards into contact with said ground surface, whereafter the front end of the plow share is also lowered into contact with the ground surface about a rear support point of said plow share with said ground surface, and such that said plow share movement pattern will be reversed when the flow of hydraulic fluid passes in an opposite direction in said circuit.

2. An assembly according to claim 1, wherein the joint means includes means for enabling the front end of the plow share to move freely between two vertically separated end positions relative to the vehicle, wherein the plow share has a scraper edge which in one end position is raised above a plane defined by contact of vehicle wheels with the ground surface, and in an other end-position is lowered to a chosen extent beneath said plane.

3. An assembly according to claim 1, wherein the bracing means is coupled to a tow hook located centrally on the rear part of the vehicle.

4. An assembly according to claim 1, wherein the lifting means engages the plow share at a position forwardly of the centre of gravity of the planar share, so that the forward end of the plow share will first be lifted from the ground surface in one lifting manoeuvre and will engage said ground surface last in a lowering manoeuvre.

5. An assembly according to claim 1, wherein the vehicle includes an hydraulic unit having an hydraulic circuit for a working unit; and in that the hydraulic circuit of the side plan assembly can be connected to the hydraulic unit through a medium of control means; and in that the hydraulic circuit of said side plow share assembly includes means for initiating a flow of hydraulic fluid therethrough in selectable directions.

6. A side plow assembly for mounting on an automotive vehicle and comprising a plow share capable of being fitted on a side of said vehicle, wherein a front end of the share as seen in a normal direction of travel of said vehicle is capable of being pivotally connected to the vehicle by joint means, wherein a rear part of the plow share, as seen in the normal direction of vehicle travel, is capable of being connected to a rear part of the vehicle by bracing means having a variable length for variation of an angle of the plow share in the horizontal plane relative to the direction of vehicle travel, wherein the bracing means is pivotally connected to the vehicle, and wherein the assembly includes lifting means capable of being connected between the plow share and the vehicle and functioning to lift the plow share from a ground surface and to lower said plow share into contact with said ground surface respectively, the joint means including means for enabling the front end of the plow share to move freely between two vertically separated end positions relative to the vehicle, wherein the plow share has a scraper edge which in one end position the scraper edge is raised above a plane defined by contact of vehicle wheels with the ground surface, and in the other end-position the scraper edge is lowered to a position extending beneath said plane, the lifting means engaging the plow share at a position forwardly of the centre of gravity of the plow share, so that a forward end of the plow share will first be lifted from the ground surface in one lifting manoeuvre and will engage said ground surface last in a lowering manoeuvre, the bracing means including a double-acting hydraulic cylinder and the lifting means including a double-acting hydraulic cylinder, the two hydraulic cylinders being connected in series in an hydraulic circuit in a manner such that with the plow share lifted and folded-in against the side of the vehicle a flow of hydraulic fluid through the circuit in one direction will cause the rear part of the plow share to swing outwards and also downwards into contact with said ground surface, whereafter the front end of the plow share is also lowered into contact with the ground surface about a rear support point of said share plow with said ground surface, and such that said plow share movement pattern will be reversed when the flow of the hydraulic fluid passes in an opposite direction in said circuit.

7. An assembly according to claim 6, wherein the bracing means is coupled to a tow hook located centrally on the rear port of the vehicle.

* * * * *